US010557639B2

(12) United States Patent
Ahn et al.

(10) Patent No.: US 10,557,639 B2
(45) Date of Patent: Feb. 11, 2020

(54) DEHUMIDIFIER

(71) Applicant: Samsung Electronics Co., Ltd, Gyeonggi-do (KR)

(72) Inventors: Jong Chul Ahn, Seoul (KR); Sang Ki Yoon, Gyeonggi-do (KR); Ha Young Yoon, Gyeonggi-do (KR); Kwon Jin Kim, Gyeonggi-do (KR); Nak Hyun Kim, Gyeonggi-do (KR); Young Hoon Kim, Gyeonggi-do (KR); Kang Ho Choi, Gyeonggi-do (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 95 days.

(21) Appl. No.: 15/156,235

(22) Filed: May 16, 2016

(65) Prior Publication Data

US 2016/0334118 A1 Nov. 17, 2016

(30) Foreign Application Priority Data

May 15, 2015 (KR) ..... 10-2015-0067898

(51) Int. Cl.
*F24F 3/14* (2006.01)
*F25D 21/14* (2006.01)
(Continued)

(52) U.S. Cl.
CPC ..... *F24F 3/1405* (2013.01); *F24F 13/222* (2013.01); *F24F 13/28* (2013.01);
(Continued)

(58) Field of Classification Search
CPC ..... F24F 3/1405; F24F 13/222; F24F 13/28; F24F 13/30; F24F 1/022;
(Continued)

(56) References Cited

U.S. PATENT DOCUMENTS 6,684,458 B1 * 2/2004 Sargant ..... A47G 19/22 16/425
2006/0278084 A1 12/2006 Kim
(Continued)

FOREIGN PATENT DOCUMENTS

JP 2000-070656 * 2/2000
JP 2004-061042 A * 2/2004
(Continued)

OTHER PUBLICATIONS

"Machine Translation of JP 2007-253138, Kawamoto et al., Mar. 2007".*
(Continued)

*Primary Examiner* — Frantz F Jules
*Assistant Examiner* — Martha Tadesse

(57) ABSTRACT

Disclosed herein is a dehumidifier which has an improved structure capable of improving a user convenience of a water container. The dehumidifier includes a main body including an inlet port and an outlet port, a heat exchanger which exchanges heat with air introduced through the inlet port and a water container which accommodates condensate and is separately coupled to the main body in a sliding manner. The water container includes a handle rotatably coupled to the water container.

20 Claims, 15 Drawing Sheets

(51) Int. Cl.
*F24F 13/30* (2006.01)
*F24F 13/22* (2006.01)
*F24F 13/28* (2006.01)

(52) U.S. Cl.
CPC ..... *F24F 13/30* (2013.01); *F25D 21/14* (2013.01); *F24F 2003/1446* (2013.01)

(58) Field of Classification Search
CPC ..... F24F 2003/1446; F24F 2006/008; F25D 21/14; B01D 2257/80
See application file for complete search history.

(56) References Cited

U.S. PATENT DOCUMENTS

2006/0278085 A1* 12/2006 Kim ..... B01D 53/261 96/140
2009/0120118 A1* 5/2009 Yoon ..... F24F 3/14 62/259.1
2011/0100998 A1* 5/2011 Komaki ..... B41J 2/17513 220/500

FOREIGN PATENT DOCUMENTS

| | | | | |
|---|---|---|---|---|
| JP | 2007216090 | A | * | 8/2007 |
| JP | 2007253138 | A | * | 10/2007 |
| JP | 2007253138 | A | * | 10/2007 |
| JP | 2010-99548 | | | 5/2010 |
| KR | 10-2005-0013284 | | | 2/2005 |
| KR | 10-2006-0129672 | | | 12/2006 |
| KR | 10-2013-0138478 | | | 12/2013 |

OTHER PUBLICATIONS

"Machine Translation of JP 2004-061042, Tsuchida, Feb. 2004".*
European Patent Office, "European Search Report," Application No. EP 16169054.0, dated Oct. 4, 2016, 6 pages.

* cited by examiner

DEHUMIDIFIER

CROSS-REFERENCE TO RELATED APPLICATION

This application claims the benefit of Korean Patent Application No. 10-2015-0067898, filed on May 15, 2015 in the Korean Intellectual Property Office, the disclosure of which is incorporated herein by reference.

TECHNICAL FIELD

Embodiments of the present disclosure relate to a dehumidifier, and more particularly to a dehumidifier which has an improved structure capable of improving a use convenience of a water container.

BACKGROUND

Generally, a dehumidifier is an apparatus which inhales humid air into an inner space of a main body, decreases humidity by passing the air through a heat exchanger including a condenser and an evaporator through which a refrigerant flows, and discharges the dehumidified air to the indoor space, and thus indoor humidity is decreased.

That is, a dehumidifier absorbs heat from nearby air by evaporating a liquid state refrigerant in an evaporator, and while the refrigerant is being evaporated, a temperature of the evaporator is decreased and a temperature of air which passes through the evaporator is also decreased.

Accordingly, as a temperature near the evaporator is decreased, water included in air is condensed and then dew forms at a surface of the evaporator.

A water container which stores condensate formed at the surface of the evaporator may be provided in the dehumidifier.

When the water container is filled with the condensate, a user has to separate the water container from a main body using hands for emptying out the water container. While the water container is separated from the main body using the hands, the user has to accept inconvenience such as bending the body or kneeling a lot. In addition, the user has to accept inconvenience such as uncovering cover of the water container to empty out the water container.

SUMMARY

Therefore, it is an aspect of the present disclosure to provide a dehumidifier which has an improved structure capable of separating a water container from a main body using one hand.

It is another aspect of the present disclosure to provide a dehumidifier which has an improved structure capable of separating a water container from a main body and moving the water container separated from the main body using one handle It is still another aspect of the present disclosure to provide a dehumidifier which has an improved structure capable of removing condensate in a water container without separating a cover of the water container.

Additional aspects of the disclosure will be set forth in part in the description which follows and, in part, will be obvious from the description, or may be learned by practice of the disclosure.

In accordance with one aspect of the present disclosure, a dehumidifier may include a main body including an inlet port and an outlet port, a heat exchanger which exchanges heat with air introduced through the inlet port and a water container which accommodates condensate and is separately coupled to the main body in a sliding manner. The water container may include a handle rotatably coupled to the water container.

The outlet port may be provided at the main body to be opened and closed at a front of the main body, and the water container may be separated from the main body forward of the main body in a sliding manner.

A water container seating portion recessively formed for the water container to be seated may be provided on one surface of the main body, and a coupling portion separately coupled to a protrusion rib formed on one surface of the water container by elastic deformation may be provided on the water container seating portion.

A water container seating portion recessively formed for the water container to be seated may be provided on one surface of the main body, and the water container may be separately coupled to the water container seating portion to form an exterior of at least one of a front surface and side surfaces of the dehumidifier together with the main body.

A recessed member recessively formed inward of the water container may be formed at a front surface of the water container to be adjacent to the handle.

The recessed member may be welded to the front surface of the water container.

The handle may be separately coupled to the water container.

The handle may include a support portion separately coupled to the water container and a grip portion connected to the support portion to be gripped.

The support portion and the grip portion may be integrally formed with each other.

The grip portion may include a first surface facing an inner side of the water container and the first surface may include a curved surface which is convex toward the inner side of the water container.

The grip portion may further include a second surface facing an outside of the water container and the second surface may form a part of an exterior of the dehumidifier when the water container is coupled to the main body.

The grip portion may further include a third surface which connects the first surface to the second surface and at least one of a connection portion between the first surface and the third surface and a connection portion between the second surface and the third surface may include a curved surface.

A plurality of handle installation portions each of which includes a coupling hole and protrudes toward an inner side of the water container may be provided at an inner wall of the water container and a coupling protrusion which protrudes toward an outside of the handle and is separately coupled to the coupling hole may be provided at the support portion.

The coupling protrusion may be separable from the coupling hole when the handle is leaned toward a rear of the water container.

At least one of the water container and the handle may be formed of a transparent material.

In accordance with another aspect of the present disclosure, a dehumidifier may include a main body including an inlet port and an outlet port, a heat exchanger which exchanges heat with air introduced through the inlet port and a water container which is separably coupled to the main body in a sliding manner and linearly moves when being separated from the main body. The water container may include a handle separately coupled to the water container to be gripped when the water container is separated from the main body and while the water container separated from the main body is lifted and transferred.

The outlet port may be provided at the main body to be opened and closed at a front of the main body, and the water container may be separated from the main body in a sliding manner forward of the main body.

A water container seating portion recessively formed for the water container to be seated may be provided on a front surface of the main body, and the water container may be separately coupled to the water container seating portion to form an exterior of a front surface of the dehumidifier together with the main body.

The handle may be leaned toward a front of the dehumidifier when the water container is coupled to the main body and one surface of the handle leaned toward a front surface of the dehumidifier may form an exterior of a front surface of the dehumidifier together with the water container and the main body.

The handle may be separately coupled to the water container.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Hereinafter, the exemplary embodiment of the present disclosure will be described in detail with reference to accompanying drawings. Meanwhile, the terms used in the specification, such as "a leading end", "a following end", "an upper portion", "a lower portion", "an upper end" and "a lower end" are defined based on the drawings, and shapes and positions of components are not limited to the terms.

Figure 1:
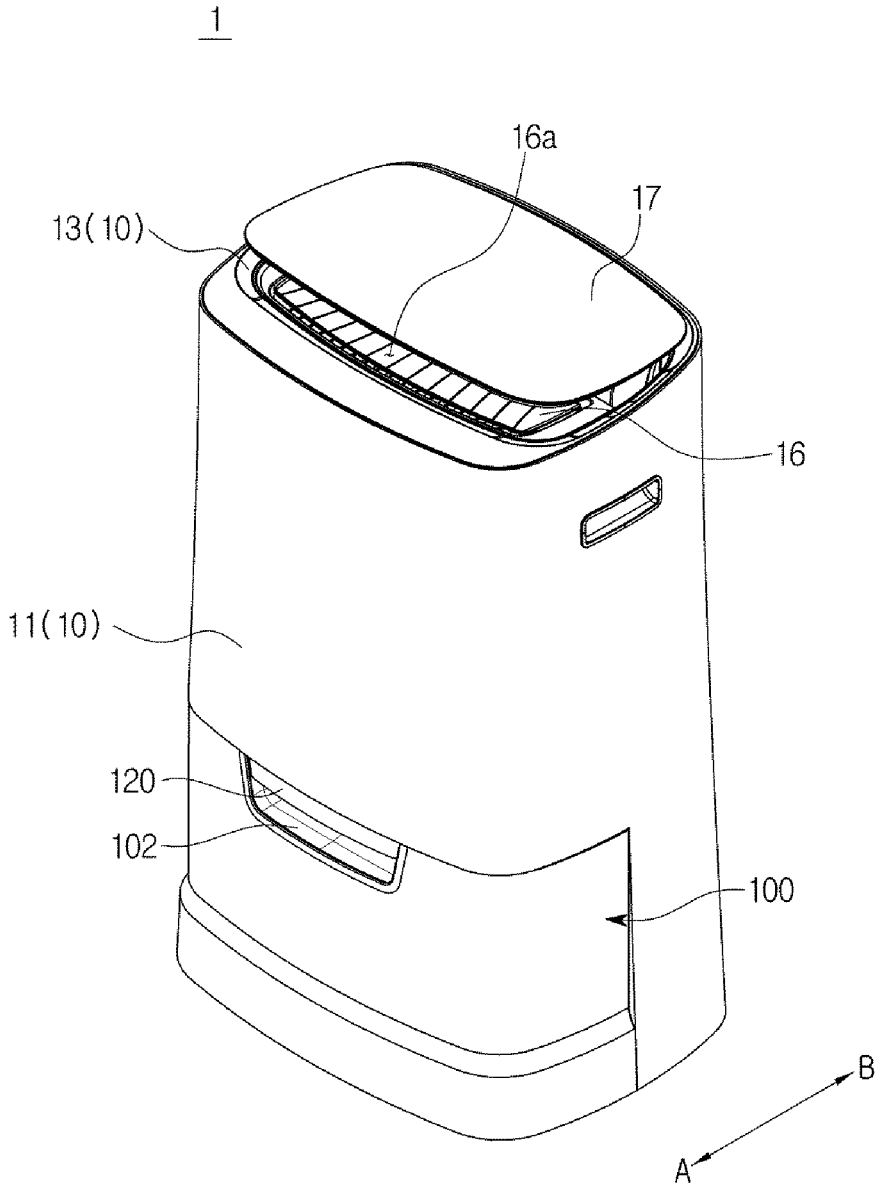
FIG. 1 is a perspective view illustrating a front surface of a dehumidifier according to one embodiment of the present disclosure.
Figure 2:
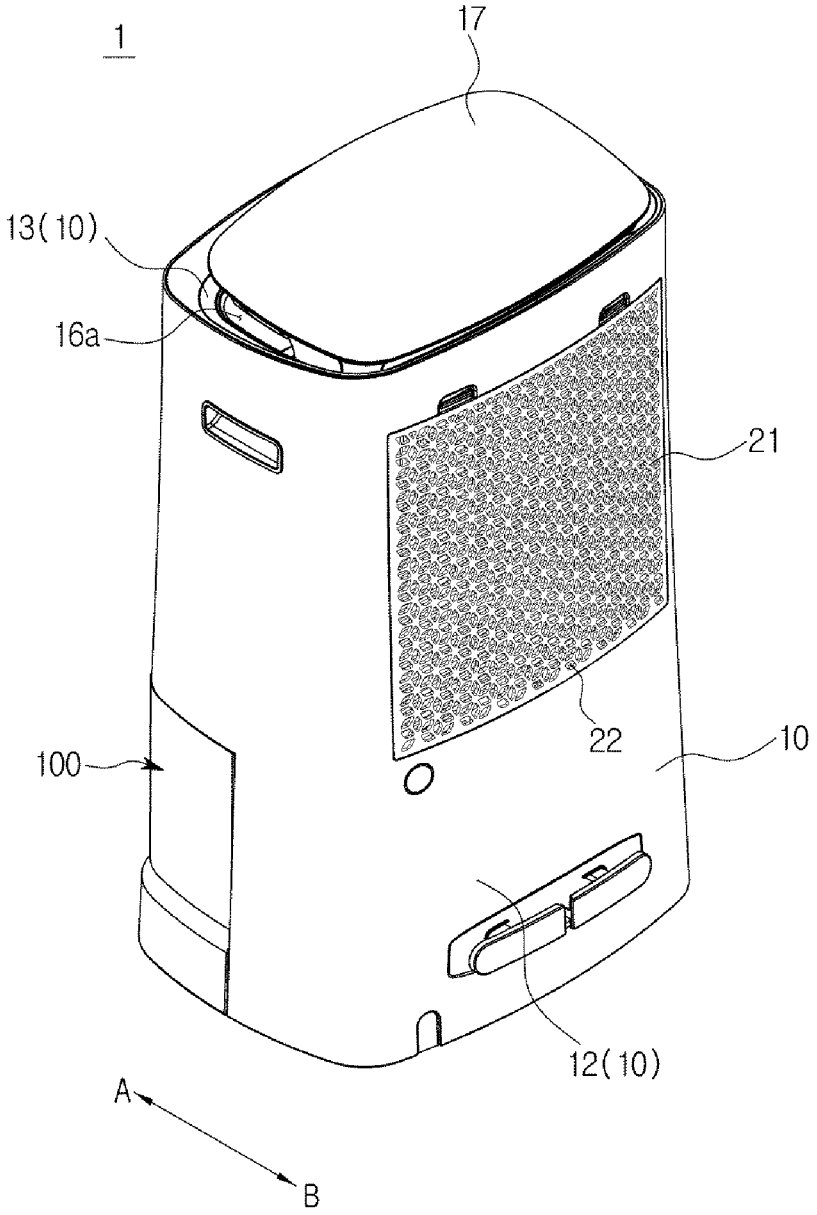
FIG. 2 is a perspective view illustrating a rear surface of the dehumidifier according to one embodiment of the present disclosure.

FIG. 1 is a perspective view illustrating a front surface of a dehumidifier according to one embodiment of the present disclosure, and FIG. 2 is a perspective view illustrating a rear surface of the dehumidifier according to one embodiment of the present disclosure. Hereinafter, a first direction A corresponds to a front side of the dehumidifier 1, and a second direction B corresponds to a rear side of the dehumidifier 1.

As illustrated in FIGS. 1 and 2, the dehumidifier 1 may include a main body 10.

The main body 10 may include a first panel 11 facing in the first direction A and a second panel 12 facing in the second direction B. The first panel 11 and the second panel 12 are separately coupled to each other and form the main body 10.

A display portion (not shown) in which an operation state of the dehumidifier 1 is displayed may be formed on the first panel 11. In addition, an operation button (not shown) which operates an operation state displayed in the display portion may be formed in the first panel 11. Positions of the display portion and the operation button are not limited to the first panel 11.

A water container 100 and the first panel 11 may form an exterior facing in the first direction A. Although the water container 100 may be positioned under the first panel 11, a positional relation of the water container 100 and the first panel 11 is not limited thereto.

Figure 6:
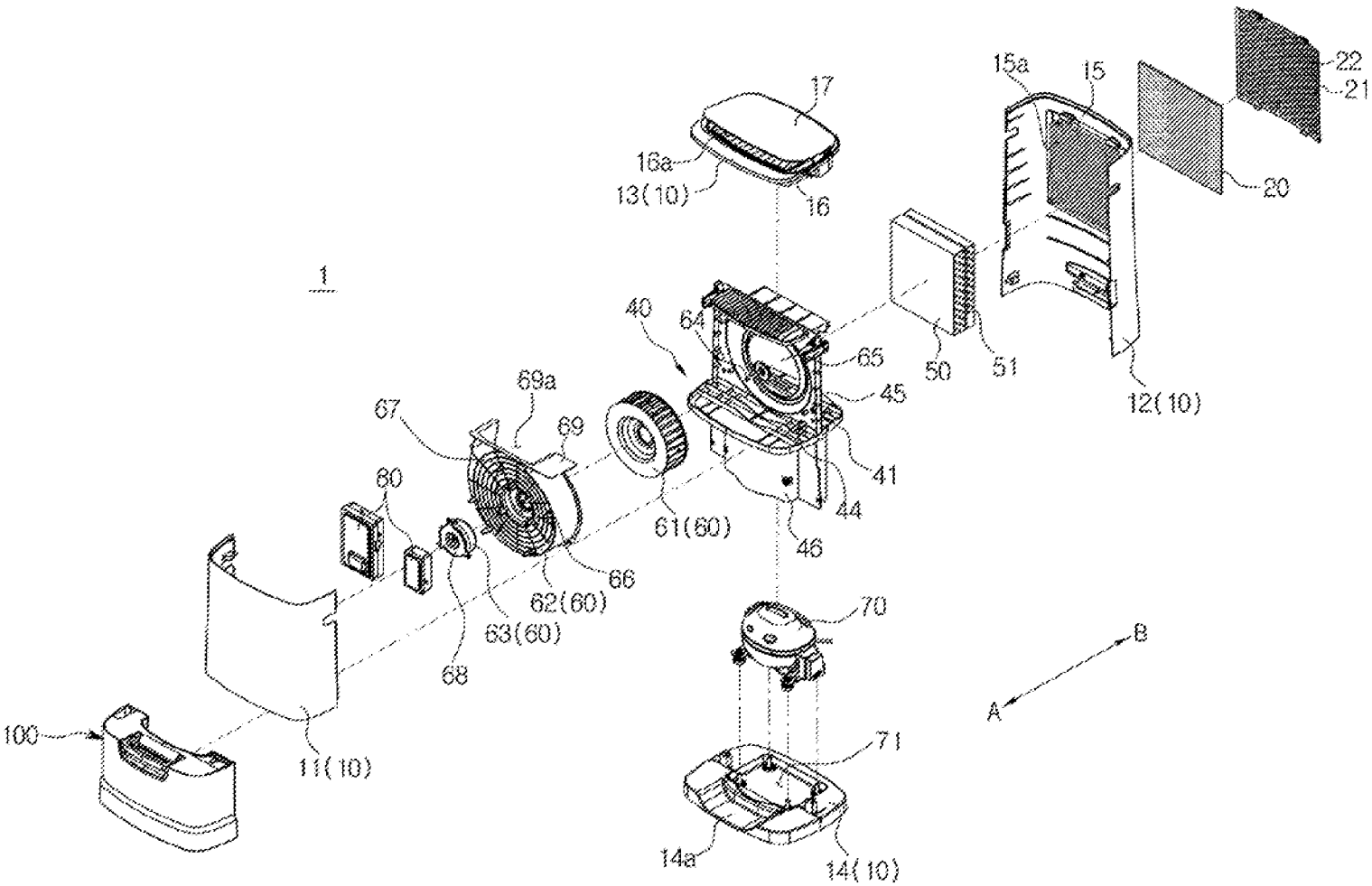
FIG. 6 is an exploded perspective view illustrating the dehumidifier according to one embodiment of the present disclosure.

An inlet grill 15 forming an inlet port 15*a* may be provided at the second panel 12 (see FIG. 6). A filter 20 may be installed at an outside of the second panel 12 such that air introduced into the main body 10 through the inlet port 15*a* is purified (see FIG. 6). The filter 20 may serve to filter foreign materials in air introduced into the main body 10, and may have a size corresponding to that of the inlet grill 15. The filter 20 may be fixed to the second panel 12 by a filter cover 21 coupled to the second panel 12 at the outside of the filter 20 to face the inlet grill 15. The filter cover 21 may be separately coupled to the second panel 12 such that the filter 20 is easily replaced.

A plurality of opening holes 22 may be formed in the filter cover 21, and air introduced through the plurality of opening holes 22 is introduced into main body 10 through the filter 20 and the inlet port 15*a*.

The filter 20 may include at least one of a free filter which removes relatively large dusts included in air, a deodorization filter which removes odors, a dust collection filter which collects dusts using an electrical effect, and a hepa filter which removes microdusts.

The filter 20 may also be positioned inside the second panel 12.

The main body 10 may further include a third panel 13 positioned above the first panel 11 and the second panel 12. The third panel 13 forms the exterior of the dehumidifier 1 by being coupled to the first panel 11 and the second panel 12.

An outlet port 16*a* may be provided at the main body 10 so as to be opened and closed at a front of the main body 10. Specifically, an outlet grill 16 forming the outlet port 16*a* may be provided at the third panel 13. Air introduced into the main body 10 through the inlet port 15*a* is discharged to the outside through the outlet port 16*a*.

The outlet port 16*a* may be opened and closed by an outlet louver 17 coupled to the third panel 13. When the dehumidifier 1 is operated by an operation of the operation button, the outlet louver 17 moves upward and the outlet port 16*a* is opened. When the dehumidifier 1 stops the operating, the outlet louver 17 moves downward, and the outlet port 16*a* is closed. Accordingly, malfunctions of the dehumidifier 1 due to foreign materials which permeate an inside of the main body 10 may be prevented.

Figure 3:
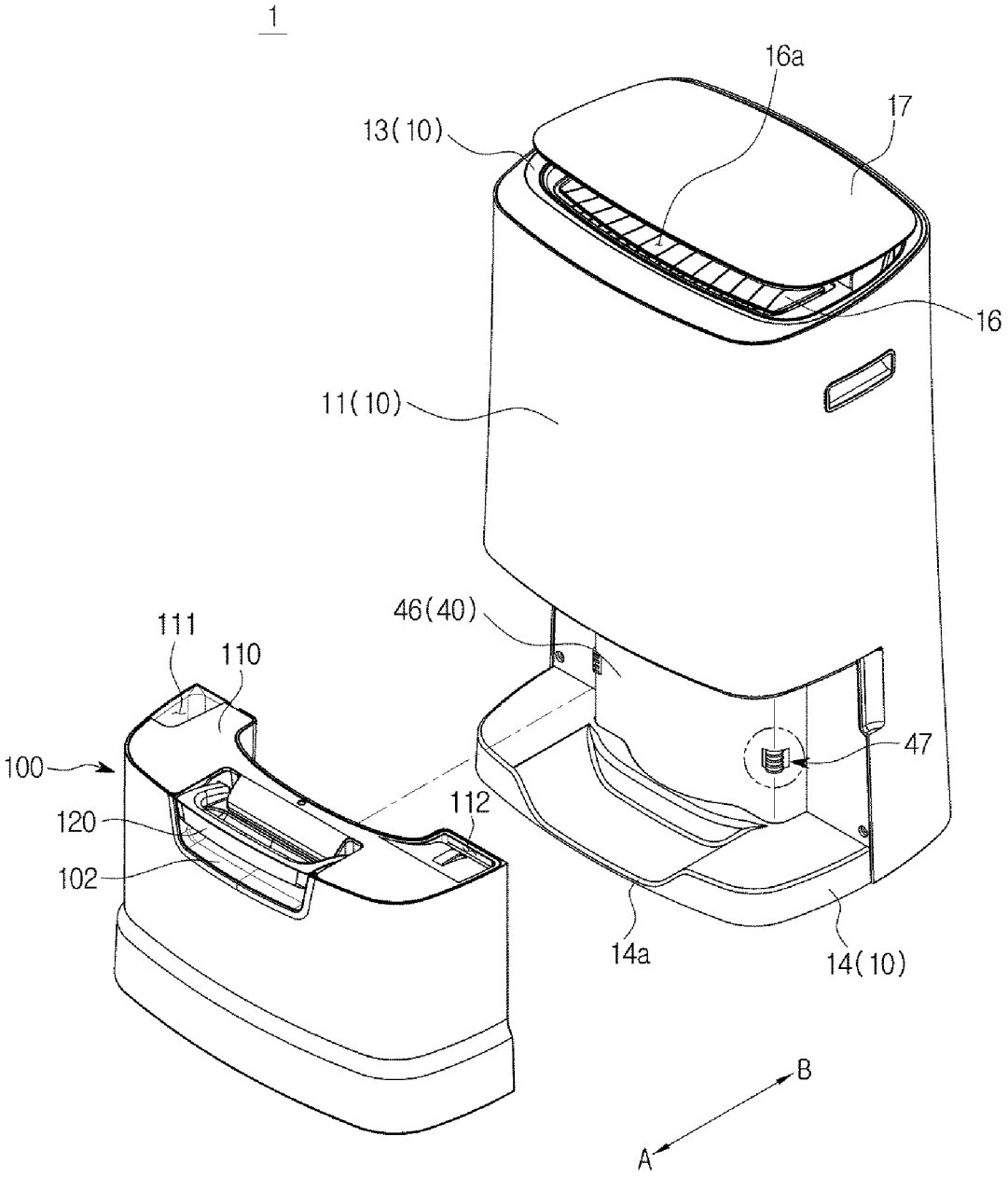
FIG. 3 is a perspective view illustrating when the water container of the dehumidifier according to one embodiment of the present disclosure is separated from a main body.

The main body 10 may further include a fourth panel 14 positioned under the first panel 11 and the second panel 12 (see FIG. 3). The fourth panel 14 forms the exterior of the dehumidifier 1 by being coupled to the first panel 11, the second panel 12, and third panel 13.

Figure 4:
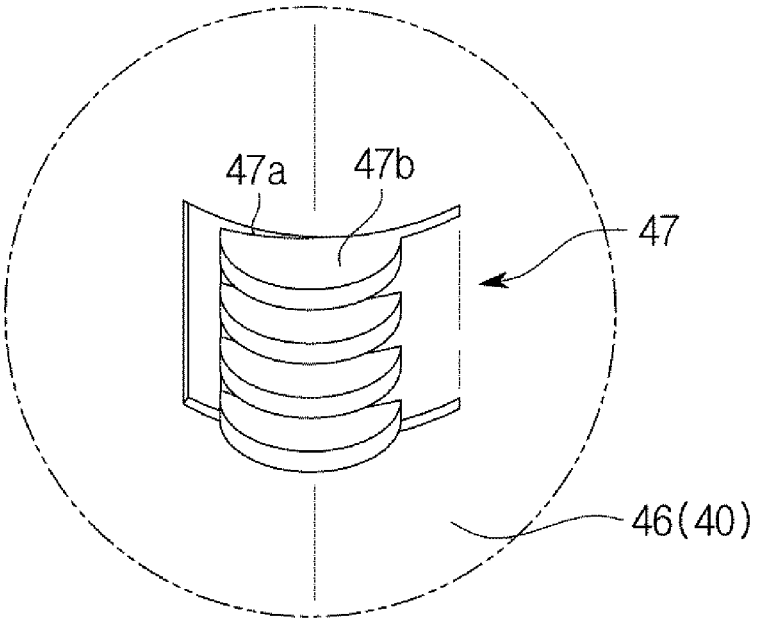
FIG. 4 is an enlarged view illustrating a part of FIG. 3.
Figure 5:
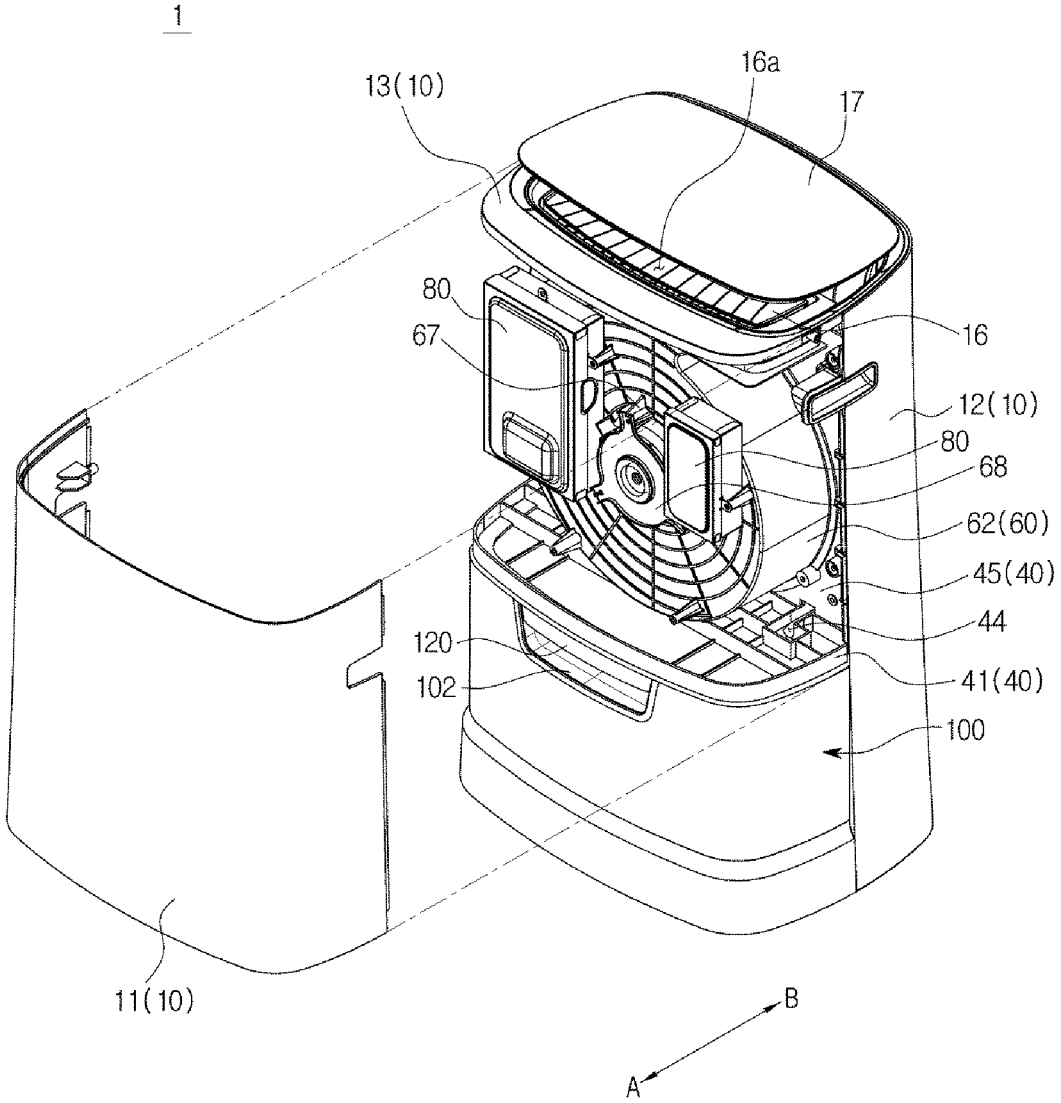
FIG. 5 is a perspective view illustrating the dehumidifier with a front surface thereof open according to one embodiment of the present disclosure.

FIG. 3 is a perspective view illustrating when the water container of the dehumidifier according to one embodiment of the present disclosure is separated from a main body, and FIG. 4 is an enlarged view illustrating a part of FIG. 3. FIG. 5 is a perspective view illustrating the dehumidifier with a front surface thereof open according to one embodiment of the present disclosure, and FIG. 6 is an exploded perspective view illustrating the dehumidifier according to one embodiment of the present disclosure.

As illustrated in FIGS. 3 to 6, the dehumidifier 1 may further include a heat exchanger 50, a blowing assembly 60, and a compressor 70 as well as the main body 10.

The main body 10 may further include a frame 40.

A part of the frame 40 may be provided in the main body 10. The first panel 11 is positioned at the first direction A of the frame 40, and the second panel 12 is positioned at the second direction B of the frame 40. The third panel 13 in which the outlet grill 16 is formed is coupled to an upper side of the frame 40, and the fourth panel 14 is coupled to a lower side of the frame 40.

The frame 40 may include a plate 41. The heat exchanger 50 provided inside the second panel 12 may be installed on the plate 41.

Air introduced into the main body 10 through the inlet port 15*a* exchanges heat with a refrigerant which circulates the heat exchanger 50. The dehumidifier 1 may include at least one heat exchanger 50. At least one heat exchanger 50 may be installed to face each other. Although at least one heat exchanger 50 may have sizes different from each other, the sizes of at least one heat exchanger 50 are not limited thereto. The heat exchanger 50 may include a plurality of pipes 51 in which inner paths are connected to each other such that air introduced into the main body 10 through the inlet port 15*a* exchanges more heat with a refrigerant.

The heat exchanger 50 may serve as a compressor and an evaporator.

A flow path 44 which guides condensate generated in a heat exchange process and formed on the heat exchanger 50 to the water container 100 may be formed in the plate 41.

The frame 40 may further include a blower fan seating portion 45 coupled to an upper side of the plate 41 and a water container seating portion 46 coupled to a lower side of the plate 41. That is, the plate 41 may divide the frame 40 into the blower fan seating portion 45 and the water container seating portion 46. The water container seating portion 46 may be described from the other aspect as follows. The water container seating portion 46 may be recessively formed such that the water container 100 is seated on one surface of the main body 10. Specifically, the water container seating portion 46 may be formed at the one surface of the main body 10 directed in the first direction A.

The blowing assembly 60 serves to discharge air introduced into the main body 10 through the inlet port 15*a* to the outside through the outlet port 16*a*. The blowing assembly 60 may include a blower fan 61, a blower fan housing 62, and a blower motor 63.

The blower fan 61 rotates such that air is suctioned through the inlet port 15*a* and discharged through the outlet port 16*a*. The blower fan housing 62 accommodates and supports the blower fan 61. The blower motor 63 supplies rotation power to rotate the blower fan 61.

The blower fan housing 62 may be coupled to the blower fan seating portion 45 directed in the first direction A to face an inner surface of the first panel 11. The blower fan 61 accommodated in the blower fan housing 62 may be installed in the seating hole 65 formed in the blower fan seating portion 45.

The blower motor 63 may be seated on the motor seating portion 66 formed in the blower fan housing 62 to be directed in the first direction A. The blower fan 61 accommodated in the blower fan housing 62 may rotate about a motor shaft 64 connected to the blower motor 63. A plurality of coupling portions 67 which are disposed along a circumference of the motor seating portion 66 and protrude in the first direction A may be formed at the blower fan housing 62. The blower motor 63 may be fixed to the motor seating portion 66 by a motor mount 68 coupled to the plurality of coupling portions 67

The blower fan housing 62 may form a discharge path 69*a* by being coupled to the blower fan seating portion 45. The discharge path 69*a* may be formed at a position corresponding to the outlet grill 16 formed at the third panel 13. Specifically, a guide duct 69 formed above the blower fan housing 62 may be connected to the outlet grill 16 to form the discharge path 69*a*. The guide duct 69 may be integrally formed with the blower fan housing 62. Accordingly, air introduced into the main body 10 through the inlet port 15*a* passes through the heat exchanger 50 and is discharged through the outlet port 16*a* along the discharge path 69*a*.

The compressor 70 which compresses a refrigerant which circulates the heat exchanger 50 may be installed in the compressor accommodation portion 71 formed on the fourth panel 14. The compressor 70 may be positioned under the plate 41 to be vertically positioned with respect to the heat exchanger 50. In addition, the compressor 70 may be disposed inside the second panel 12 so as to face the water container 100 coupled to the water container seating portion 46 while interposing the water container seating portion 46 therebetween.

The dehumidifier 1 may include an expansion valve (not shown) which depressurizes and expands a refrigerant which passes through the heat exchanger 50.

A refrigerant is compressed by the compressor 70. The refrigerant which pass through the compressor 70 is transferred to the heat exchanger 50 which serves as a condenser, is cooled and condensed by air introduced into the main body 10, and is condensed. The refrigerant which passes through the heat exchanger 50 which serves as a condenser is transferred to an expansion valve, is depressurized, and is expanded. The depressurized and expanded refrigerant absorbs heat from air introduced into the main body 10 from the heat exchanger 50 which serves as an evaporator, and is evaporated. Condensate is generated in such a heat exchange process between a refrigerant and air introduced into the main body 10, the condensate formed at the heat exchanger 50 moves along the flow path 44 formed in the plate 41 and is stored in the water container 100.

The dehumidifier 1 may further include a control box 80.

At least one control box 80 may be provided inside the first panel 11. At least one control box 80 may be installed in the blower fan housing 62 to face the inner surface of the first panel 11. Various components such as a circuit board which controls the dehumidifier 1 as a whole may be embedded in at least one control box 80 to operate the dehumidifier 1 by operation of an operation button which may be provided on the first panel 11.

The dehumidifier 1 may further include the water container 100. The water container 100 may be separately installed to the water container seating portion 46 to store condensate generated in a heat exchange process between air introduced through the inlet port 15*a* and a refrigerant.

The water container 100 may be separately coupled to the main body 10 in a sliding manner. In other words, the water container 100 may be separately coupled to the water container seating portion 46 in a sliding manner. The water container 100 may be separated from the main body 10 forward of the main body 10, that is, in the first direction A in a sliding manner.

The water container seating portion 46 may be coupled to the fourth panel 14. The water container 100 may be installed on the water container seating portion 46 to be positioned between the plate 41 and the fourth panel 14. The water container 100 installed in the water container seating portion 46 may be seated on a recessed space 14*a* which is formed in the fourth panel 14 and has a shape corresponding to a bottom surface of the container 100. The water container 100 installed at the water container seating portion 46 and the recessed space 14*a* forms the exterior of the dehumidifier 1 corresponding to the first direction A together with the first panel 11 coupled to the upper side of the plate 41. In other aspect, the water container 100 may be separately coupled to the water container seating portion 46 so as to an exterior of at least one a front surface and side surfaces of the dehumidifier 1 together with the main body 10. The water container seating portion 46 may be exposed at a side corresponding to the first direction A when the water container 100 is separated from the water container seating portion 46.

A coupling portion 47 may be provided at the water container seating portion 46. The coupling portion 47 may be provided at the water container seating portion 46 to be elastically deformable. The coupling portion 47 may include a cut portion 47*a* to be elastically deformable. The coupling portion 47 may be integrally formed with the water container seating portion 46 to have the cut portion 47*a*. The coupling portion 47 may further include at least one locking protrusion 47*b* protruding in the first direction A. The coupling portion 47 may be coupled to a protrusion rib 101 formed on one surface of the water container 100 (see FIG. 8) to be separable by elastic deformation. Specifically, the protrusion rib 101 formed one surface of the water container 100 facing the water container seating portion 46 may be separately coupled to at least one locking protrusion 47*b* of the coupling portion 47.

The water container 100 may further include a handle 120. The handle 120 may be rotatably coupled to the water container 100. In addition, the handle 120 may be separately coupled to the water container 100. The handle 120 may be rotatably coupled to the water container 100 to be gripped while the water container 100 is separated from the main body 10 in a sliding manner and while the water container 100 separated from the main body 10 is lifted and transferred.

A recessed member 102 recessed toward an inner side of the water container 100 to be adjacent to the handle 120 may be formed in a front surface of the water container 100.

The water container 100 may further include a cover 110. A drain hole 111 which is open to drain condensate stored in the water container 100 to the outside may be provided at the cover 110. Accordingly, a user may easily remove condensate through the drain hole 111 without opening or closing the cover 110 while removing the condensate in the water container 100. In addition, an inlet hole 112 which will be described below may be provided in the cover 110. The cover 110 may be separately coupled to the water container 100. The cover 110 may form a part of an exterior of the water container 100. Specifically, the cover 110 may form the upper exterior of the water container 100.

The water container 100 will be described in detail below.

Figure 7:
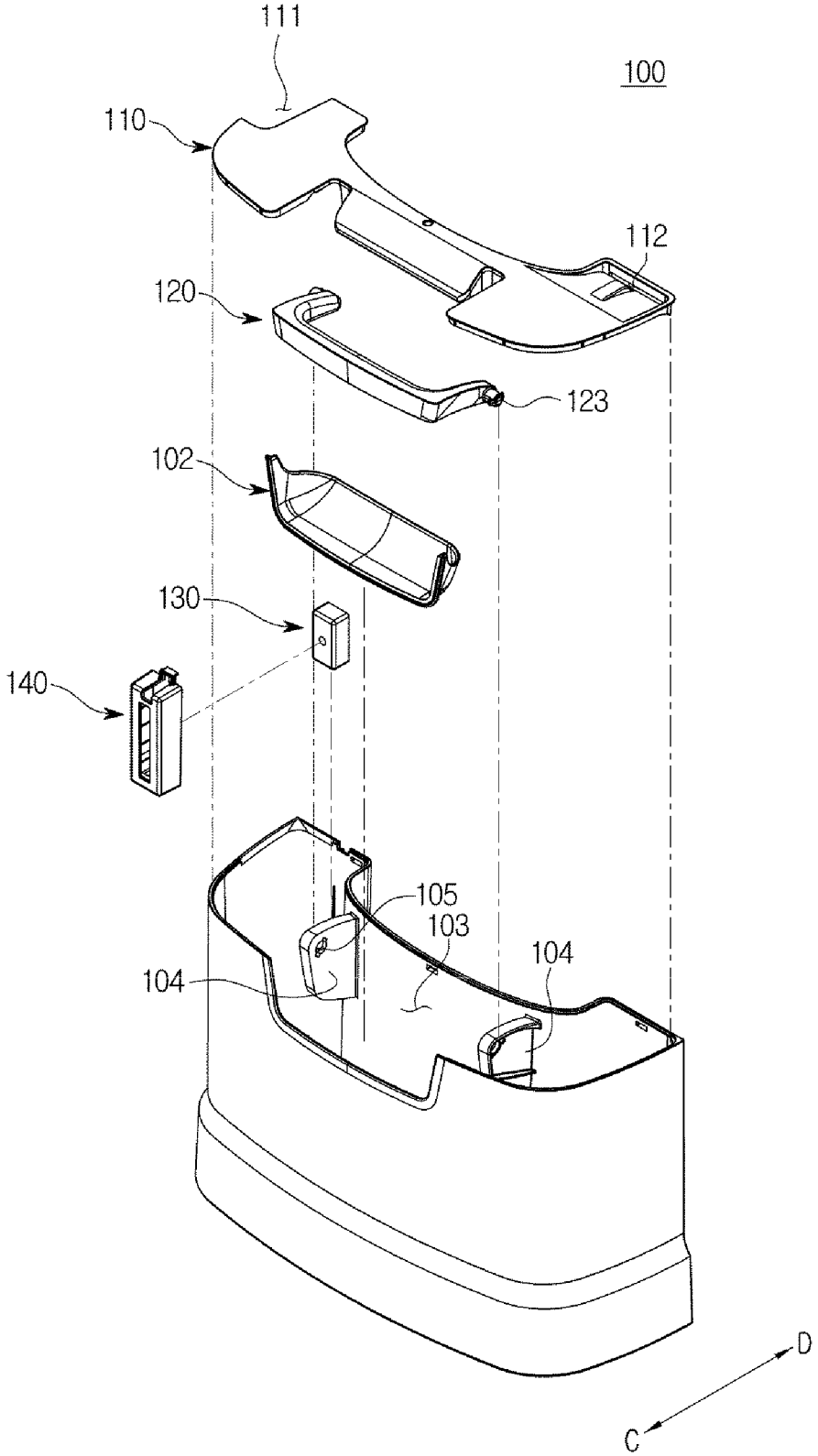
FIG. 7 is an exploded perspective view illustrating the water container of the dehumidifier according to one embodiment of the present disclosure.
Figure 8:
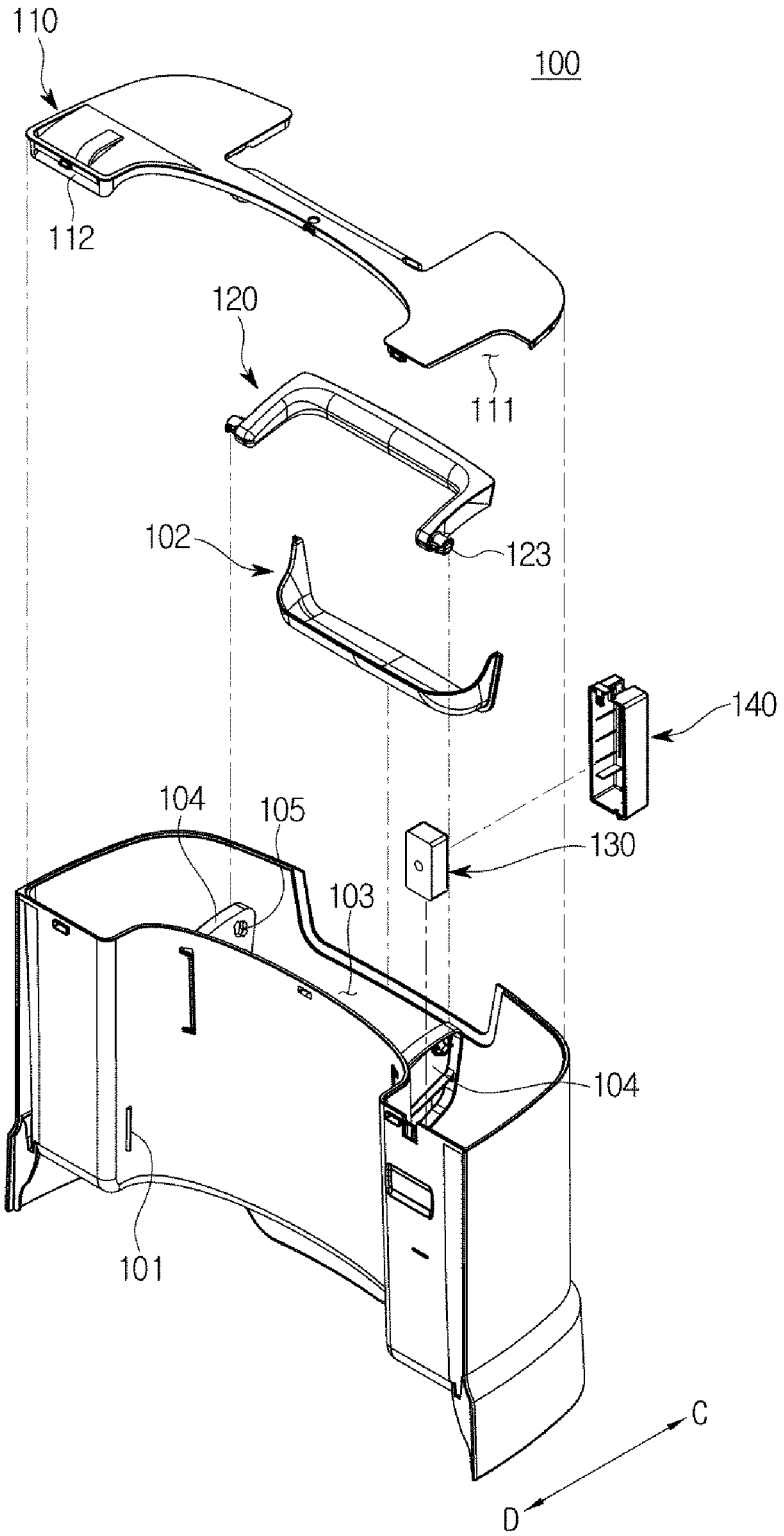
FIG. 8 is the exploded perspective view illustrating the water container of the dehumidifier according to one embodiment of the present disclosure seen from a different angle from that of the view in FIG. 7.
Figure 9:
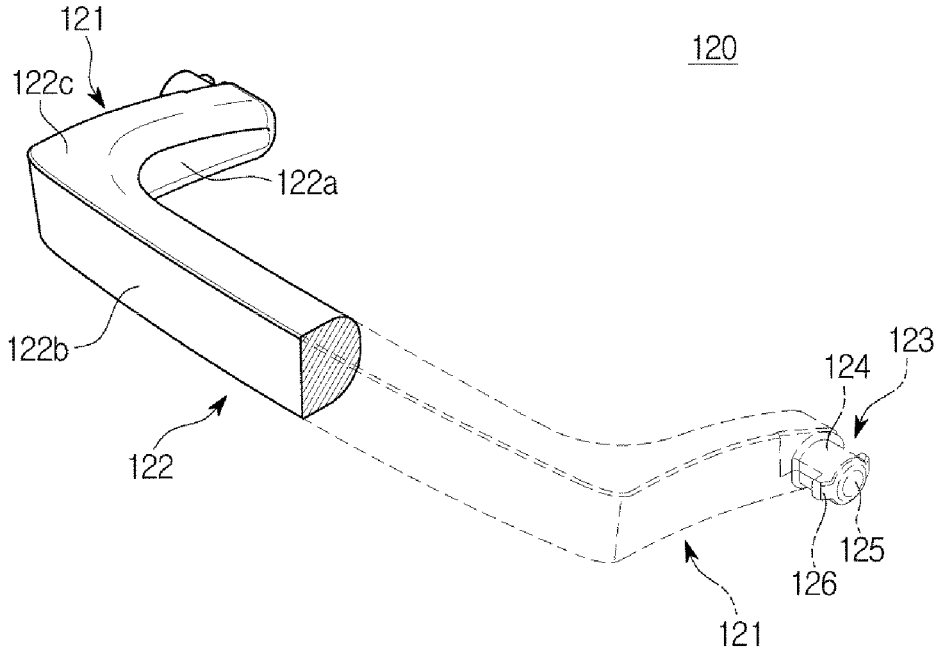
FIG. 9 is a view illustrating a handle of the dehumidifier according to one embodiment of the present disclosure.

FIG. 7 is an exploded perspective view illustrating the water container of the dehumidifier according to one embodiment of the present disclosure, and FIG. 8 is the exploded perspective view illustrating the water container of the dehumidifier according to one embodiment of the present disclosure seen from a different angle from that of the view in FIG. 7. FIG. 9 is a view illustrating a handle of the dehumidifier according to one embodiment of the present disclosure. Hereinafter, when the water container 100 is coupled to the main body 10, a front side C of the water container 100 and the first direction A may indicate the same direction. In addition, when the water container 100 is coupled to the main body 10, a rear side D of the water container 100 and the second direction B may indicate the same direction.

As illustrated in FIGS. 7 to 9, the water container 100 may further include a storage space 103. Condensate may be stored in the storage space 103 formed in the water container 100. The inlet hole 112 may be formed in a top surface of the water container 100 facing a bottom surface of the plate 41 in a state in which the water container 100 is coupled to the water container seating portion 46 such that condensate transferred from the heat exchanger 50 along the flow path 44 formed in the plate 41 is introduced into the storage space 103. Specifically, the inlet hole 112 may be formed in the cover 110 of the water container 100. The inlet hole 112 may have a hole or slit shape, however a shape of the inlet hole 112 is not limited thereto.

The recessed member 102 which is recessed toward the inner side of the water container 100 may be formed at the front surface of the water container 100 to be adjacent to the handle 120. The recessed member 102 may be formed at an upper portion of the front surface of the water container 100. The recessed member 102 may be welded to the front surface of the water container 100. It is preferable that the recessed member 102 may be vibration-welded to the front surface of the water container 100. A user may insert a hand into the recessed member 102, grip the handle 120, pull the water container 100 in the first direction A, and then separate the water container 100 from the main body 10.

The handle 120 may be separately coupled to the water container 100. Specifically, the handle 120 may be separately coupled to handle installation portions 104 formed at an inner wall of the water container 100. The handle installation portions 104 may be provided at an inner wall of a rear surface of the water container 100. The handle installation portions 104 may have a shape protruding toward the inner side of the water container 100, that is, toward the storage space 103 of the water container 100. Coupling holes 105 may be provided in the handle installation portions 104. A plurality of handle installation portions 104 may be provided. Stoppers 106 may be provided in the handle installation portions 104. The stoppers 106 may be provided in the handle installation portions 104 to be adjacent to the coupling holes 105. The stoppers 106 serves to interfere with arms 126 of coupling protrusions 123 coupled to the coupling holes 105 to hinder the handle 120 from rotating. Specifically, when the water container 100 is coupled to the main body 10, in other words, the handle 120 is leaned toward a front side C of the water container 100, the stoppers 106 interfere with the arms 126 of the coupling protrusions 123 to prevent the handle 120 from rotating a predetermined angle or above toward the front side C of the water container 100.

The handle 120 may include support portions 121 and a grip portion 122. The support portions 121 may be separately coupled to the water container 100. Specifically, the support portions 121 may be separately coupled to the handle installation portions 104. The grip portion 122 may be connected to the support portions 121 such that a user grips the grip portion 122. As one example, as illustrated in FIG. 7, the handle 120 may include a plurality of support portions 121 spaced apart from each other and separately coupled to the handle installation portions 104 and the grip portion 122 which connects the plurality of support portions 121. As another example, the handle 120 may include one support portion 121 separately coupled to the handle installation portion 104 and one grip portion 122 connected to the support portion 121.

The support portions 121 and the grip portion 122 may be integrally formed with each other.

The grip portion 122 may include a first surface 122*a* facing the inner side of the water container 100, that is, facing the storage space 103 of the water container 100. The first surface 122*a* may include a curved surface which is convex toward the inner side of the water container 100.

The grip portion 122 may further include a second surface 122*b* facing the outside of the water container 100. When the water container 100 is coupled to the main body 10, the second surface 122*b* may form a part of the exterior of the dehumidifier 1. Specifically, when the water container 100 is coupled to the main body 10, the second surface 122*b* may form a part of the front exterior of the dehumidifier 1. In other words, the second surface 122*b* may form the front exterior of the dehumidifier 1 together with the water container 100 and the main body 10.

The grip portion 122 may further include a third surface 122*c* which connects the first surface 122*a* to the second surface 122*b*.

At least one of a connection portion which connects the first surface 122*a* to the third surface 122*c* and a connection portion which connects the second surface 122*b* to the third surface 122*c* may include a curved surface.

In other aspect, the grip portion 122 of the handle 120 which may be touched by a hand of a user while the user is gripping the handle 120 may include a curved surface. The grip portion 122 of the handle 120 may have a cross-section in a "D" shape. Specifically, one surface of the grip portion 122 which faces the inner side of the water container 100 may have a curved surface, and the other surface of the grip portion 122 which faces the outside of the water container 100 may have a flat surface. As described above, by the grip portion 122 of the handle 120, touched by a hand of a user while the user is gripping the handle 120, being rounded, the grip feeling of the handle 120 may be improved. A shape of the cross-section of the grip portion 122 of the handle 120 may not be limited to a "D" shape, and may be changed variously.

The coupling protrusions 123 which protrude toward the outside of the handle 120 and are separately coupled to the coupling holes 105 may be provided on the support portions 121.

The coupling protrusions 123 may respectively include bodies 124, heads 125, and the arms 126.

The body 124 may be formed to protrude from the handle 120 toward the outside of the handle 120. Specifically, the body 124 may be formed to protrude from the support portion 121 of the handle 120 toward the outside of the handle 120. The body 124 may have a column shape.

The head 125 may be provided at one end portion of the body 124. Specifically, the head 125 may be provided at one end portion of the body 124 facing the outside of the handle 120.

The arm 126 may be formed to protrude from the head 125 toward the outside of the head 125. Specifically, when the head 125 has a circular shape, the arm 126 may be formed to protrude from the head 125 in a radius direction of the head 125.

Each of the coupling protrusions 123 may include at least one arm 126. It is preferable that the coupling protrusion 123 may include a plurality of arms 126. As one example, the arms 126 may include a first arm 126*a* and a second arm 126*b*. The first arm 126*a* and the second arm 126*b* may be formed to face each other while interposing the head 125 therebetween. The first arm 126*a*, the head 125, and the second arm 126*b* may be disposed in a straight line.

The coupling hole 105 provided in the handle installation portion 104 may have a shape corresponding to the coupling protrusion 123. The coupling hole 105 may include a first portion 105*a* and a second portion 105*b*. The first portion 105*a* may have a shape corresponding to the head 125 of the coupling protrusion 123. The second portion 105*b* may have a shape corresponding to the arm 126 of the coupling protrusion 123. When the arm 126 of the coupling protrusion 123 includes the first arm 126*a* and the second arm 126*b*, a plurality of second portions 105*b* of the coupling hole 105 may be formed. When the coupling hole 105 includes one first portion 105*a* and a plurality of second portions 105*b*, the first portion 105*a* and the plurality of second portions 105*b* may be disposed in a straight line. The straight line passed by the first portion 105*a* and the plurality of second portions 105*b* may be inclined with respect to a height direction of the water container 100. Specifically, an upper end portion of the straight line passed by the first portion 105*a* and the plurality of second portions 105*b* may be inclined toward the rear side D of the water container 100 with respect to the height direction of the water container 100. A lower end portion of the straight line passed by the first portion 105*a* and the plurality of second portions 105*b* may be inclined toward the front side C of the water container 100 with respect to the height direction of the water container 100.

At least one of the water container 100 and the handle 120 may be formed of a transparent material. By the water container 100 being formed of a transparent material, a design aspect of the water container 100 may be improved. In addition, by the water container 100 being formed of a transparent material, a user may check a water level of condensate stored in the water container 100 with the naked eye from the outside without removing the cover 110 from the water container 100. The handle 120 may be transparently formed through a gas ejection method. By the handle 120 being transparently formed, the beautiful handle 120 may be implemented.

The water container 100 may further include a water level sensor 130 and a water level sensor housing 140 accommodating the water level sensor 130. The water level sensor 130 serves as a function which senses a water level of condensate stored in the water container 100. The water level sensor housing 140 may be installed on one inner wall of the water container 100.

Figure 10:
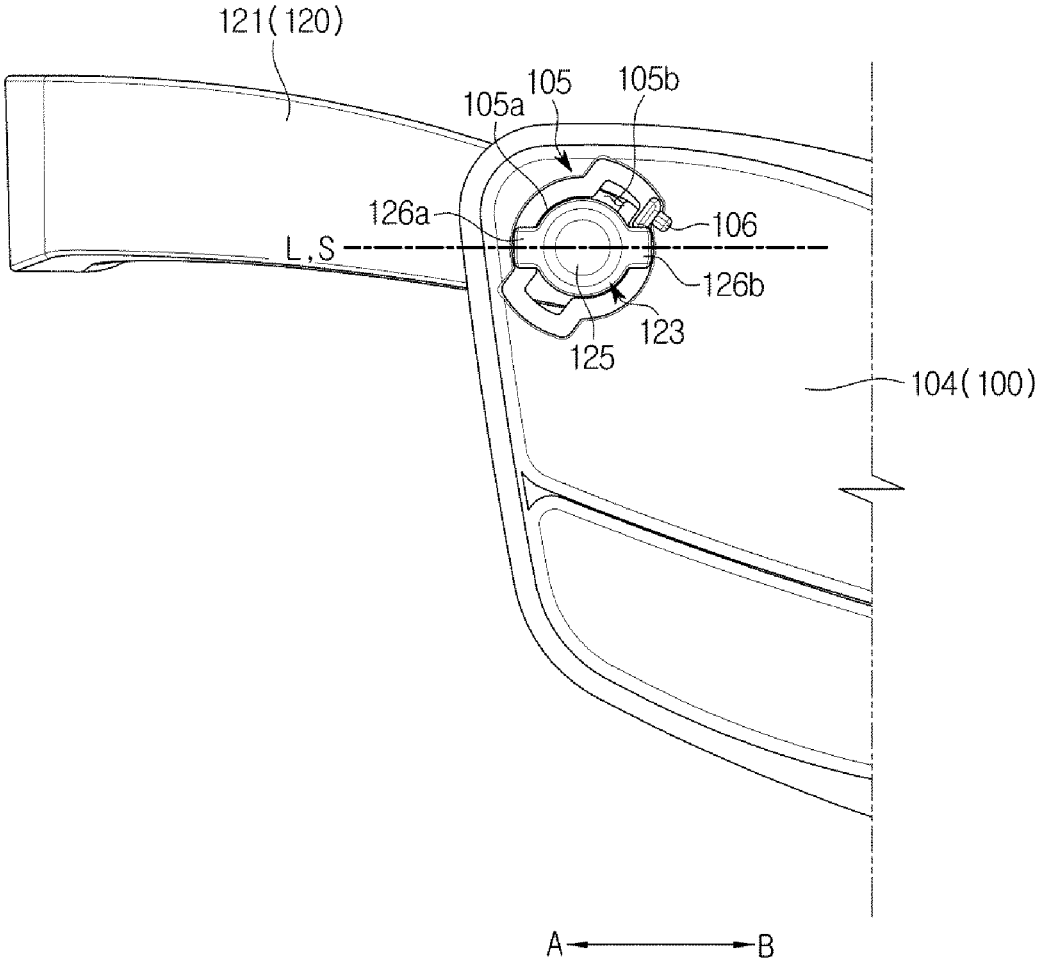
FIG. 10 is a view illustrating a state of the handle of the dehumidifier according to one embodiment of the present disclosure when the water container is installed at the main body.
Figure 11:
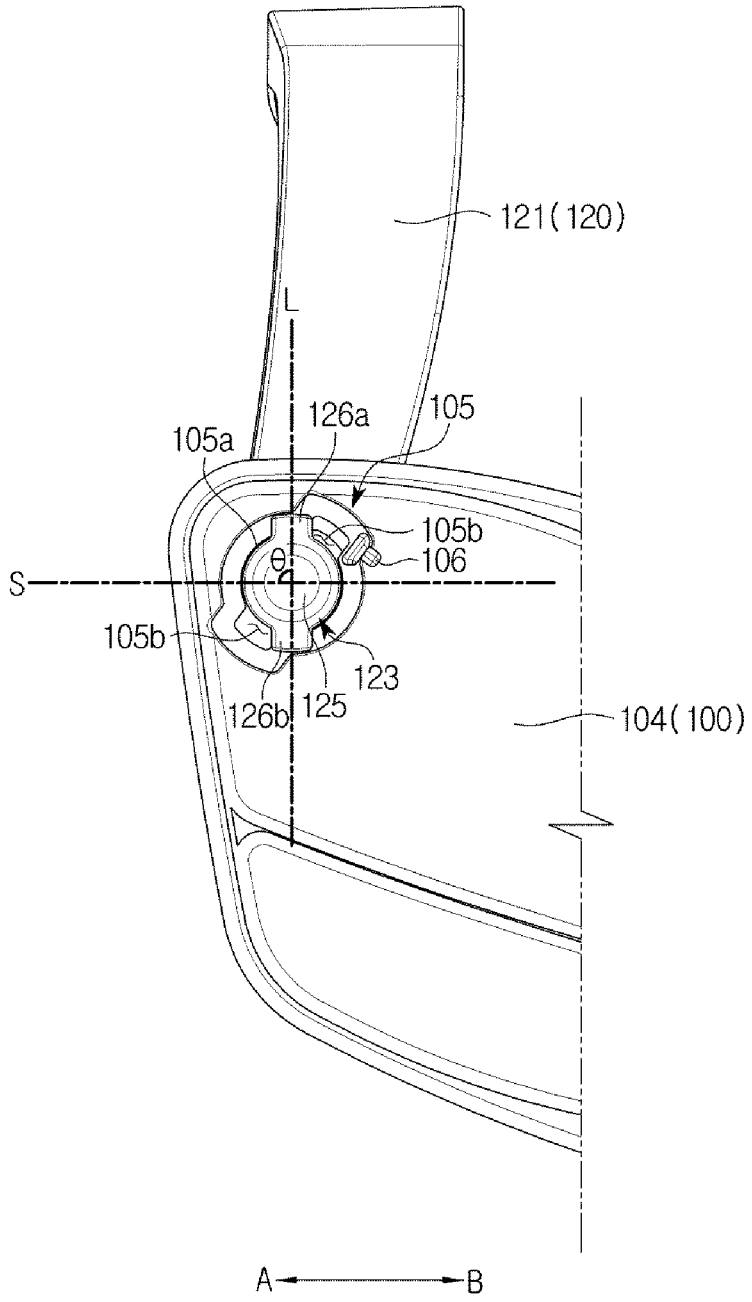
FIG. 11 is a view illustrating a stated of the handle of the dehumidifier according to one embodiment of the present disclosure when the water container is separated from the main body and transferred.
Figure 12:
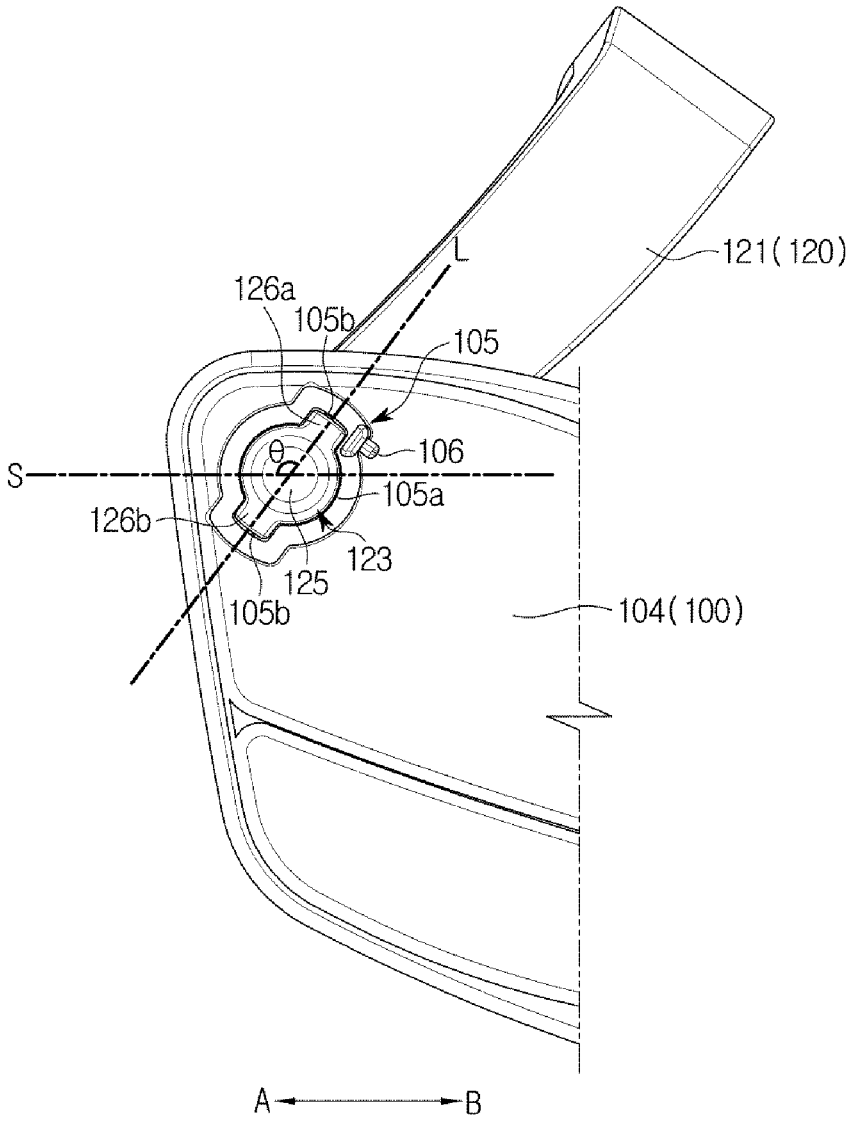
FIG. 12 is a view illustrating a state of the handle of the dehumidifier according to one embodiment of the present disclosure when the handle can be separated from the water container.

FIG. 10 is a view illustrating a state of the handle of the dehumidifier according to one embodiment of the present disclosure when the water container is installed at the main body, FIG. 11 is a view illustrating a stated of the handle of the dehumidifier according to one embodiment of the present disclosure when the water container is separated from the main body and transferred, and FIG. 12 is a view illustrating a state of the handle of the dehumidifier according to one embodiment of the present disclosure when the handle can be separated from the water container.

The handle 120 may be separately coupled to the water container 100. That is, the handle 120 may be kept coupled to the water container 100 while the water container 100 is separated from the main body 10 and the water container 100 separated from the main body 10 is lifted and transferred. In addition, when the handle 120 is leaned toward the rear side D of the water container 100, the handle 120 may be separated from the water container 100. In other words, when the handle 120 is leaned toward the rear side of the water container 100, a shape of the coupling protrusion 123 is matched a shape of the coupling hole 105 and thus the coupling protrusion 123 may be separated from the coupling hole 105.

As illustrated in FIG. 10, when the water container 100 is coupled to the main body 10, that is, when the handle 120 is leaned toward the front side C of the water container 100, the shape of the coupling protrusion 123 may not match the shape of the coupling hole 105. When the water container 100 is coupled to the main body 10, a part of the handle 120 may be seated on an upper portion of the recessed member 102. Specifically, when the water container 100 is coupled to the main body 10, the support portion 121 of the handle 120 may be seated on the upper portion of the recessed member 102. In other words, the water container 100 is coupled to the main body 10, the support portion 121 of the handle 120 may be supported by the upper portion of the recessed member 102. The water container 100 may be coupled to the main body 10 in a state in which the handle 120 is leaned toward the front side C of the water container 100, and at this point, the handle 120 is restricted from being rotated toward the front side C of the water container 100 above a predetermined angle by an interference effect of the stopper 106 and the arm 126.

Accordingly, when the water container 100 is coupled to the main body 10, specifically, when a part of the handle 120 is seated on the upper portion of the recessed member 102, a straight line which connects the first arm 126*a* to the second arm 126*b* to pass through the head 125 is defined as a reference line S. As illustrated in FIG. 10, when the water container 100 is coupled to the main body 10, that is, when the handle 120 is leaned toward the front side C of the water container 100, a straight line L which connects the first arm 126*a* to the second arm 126*b* to pass through the head 125 matches the reference line S. Accordingly, an angle formed between the straight line L which connects the first arm 126*a* to the second arm 126*b* to pass through the head 125 and the reference line S is 0°.

As illustrated in FIG. 11, when the water container 100 is separated from the main body 10 and is in a state in which the water container 100 can be transferred, the shape of the coupling protrusion 123 may not match the shape of the coupling hole 105. Accordingly, the handle 120 maintains a state in which the handle 120 is coupled to the water container 100. When the water container 100 separated from the main body 10 is transferred, an angle between the straight line L which connects the first arm 126*a* to the second arm 126*b* to pass through the head 125 and the reference line S is 90°.

As illustrated in FIG. 12, when the handle 120 is leaned to the rear side D of the water container 100, the shape of the coupling protrusion 123 may match the shape of the coupling hole 105. That is, when the handle 120 is leaned toward the rear side D of the water container 100, the coupling protrusion 123 may be separated from the coupling hole 105. In other words, when the handle 120 is leaned toward the rear side D of the water container 100, since the arm 126 matches the second portion 105*b*, the coupling protrusion 123 may be separated from the coupling hole 105. Accordingly, the handle 120 may be separated from the water container 100, that is, from the handle installation portion 104. Specifically, when the handle 120 is leaned toward the rear side D of the water container 100, and an angle between the straight line L which connects the first arm 126*a* to the second arm 126*b* to pass through the head 125 and the reference line S is 130°, the handle 120 may be separated from the water container 100. In other words, when the handle 120 is leaned toward the rear side D of the water container 100 to be 130° with respect to the reference line S, the handle 120 may be separated from the water container 100.

When the handle 120 is coupled to the water container 100, the arm 126 may move along the edge of the first portion 105*a* according to rotating of the handle 120 in a state in which the arm 126 is coupled to the edge of the first portion 105*a*.

Since attaching and detaching of the handle 120 to the water container 100 is adjusted by coupling and separating of the coupling protrusion 123 and the coupling hole 105, the handle 120 may be separately coupled to the water container 100 without an additional coupling member.

Figure 13A:
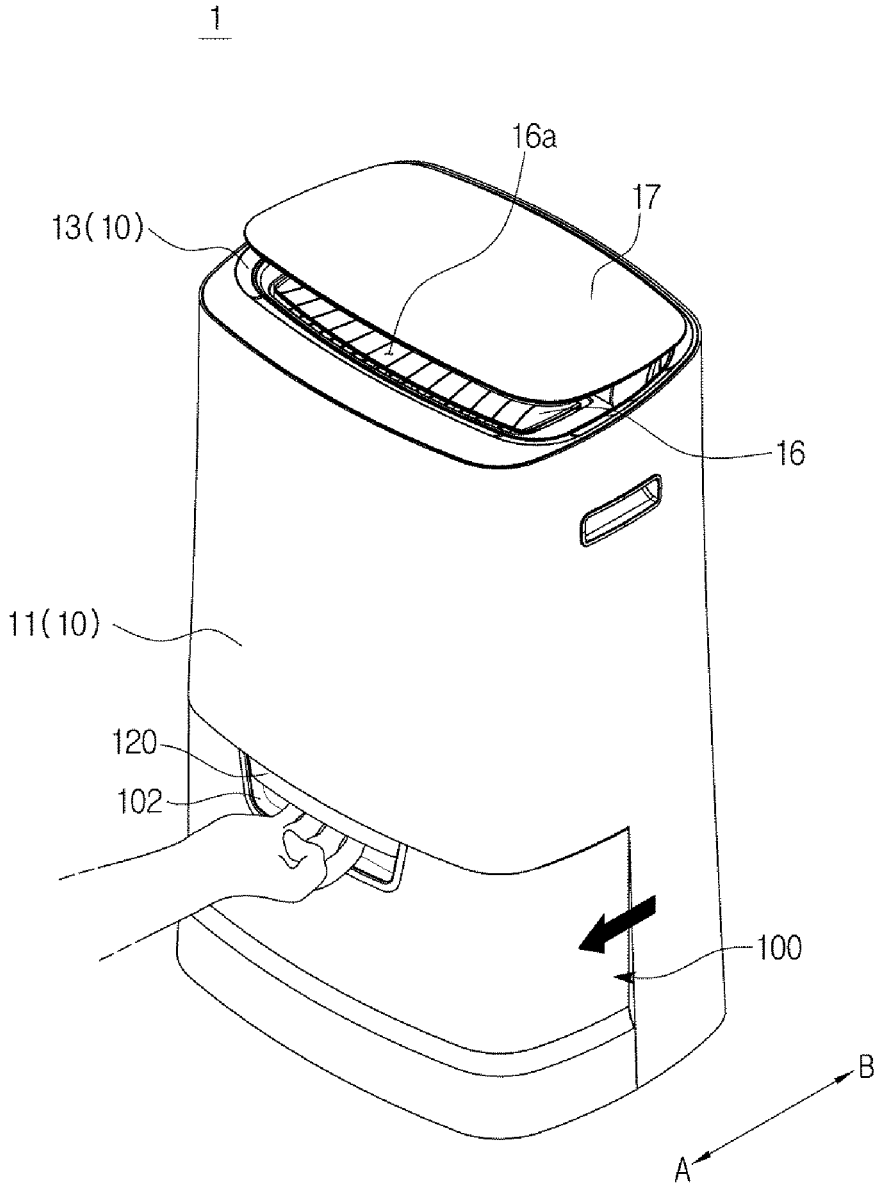
FIGS. 13A to 13C are views illustrating a sequential process in which the water container is sequentially separated from the main body of the dehumidifier according to one embodiment of the present disclosure and transferred.
Figure 13B:
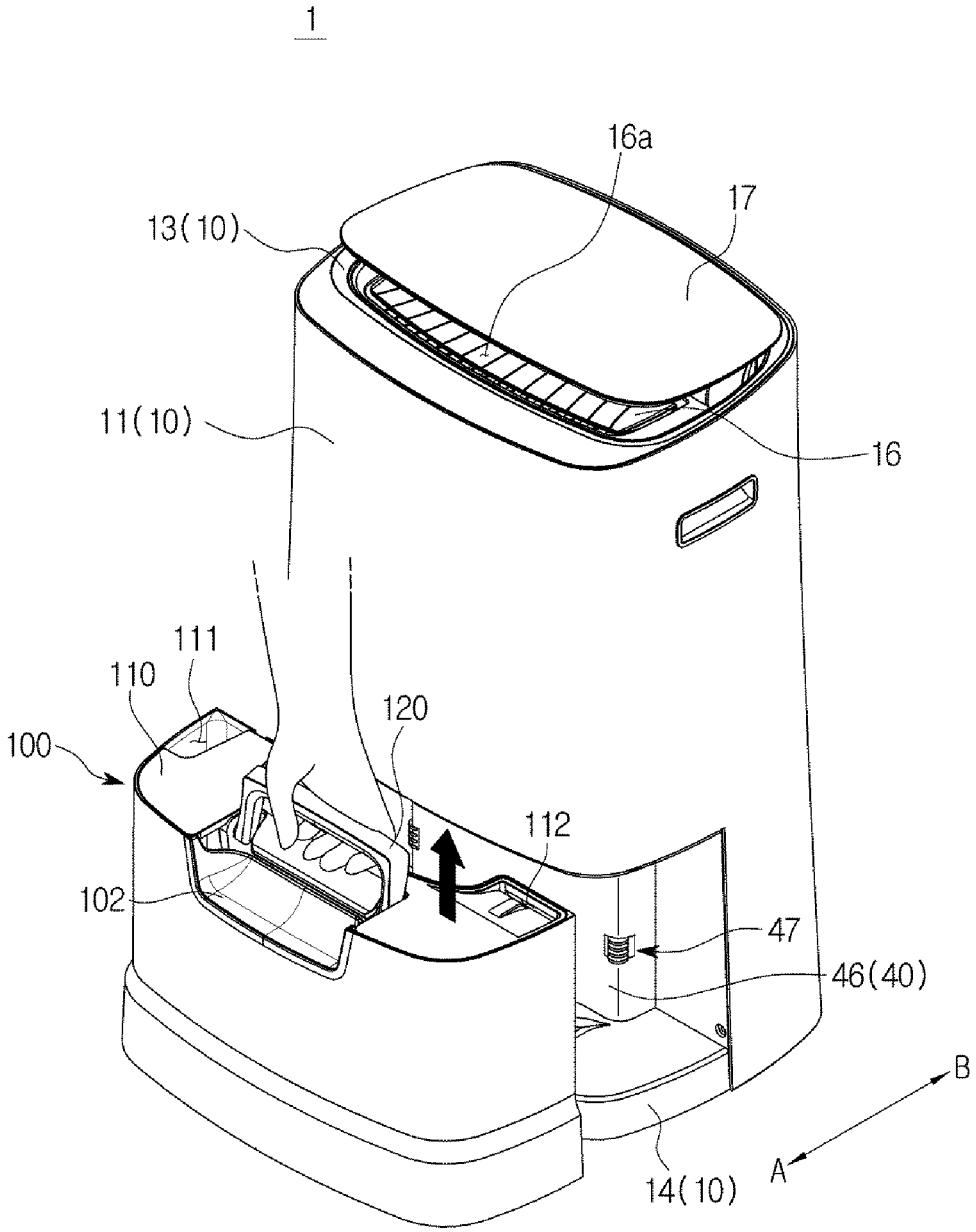
Figure 13C:
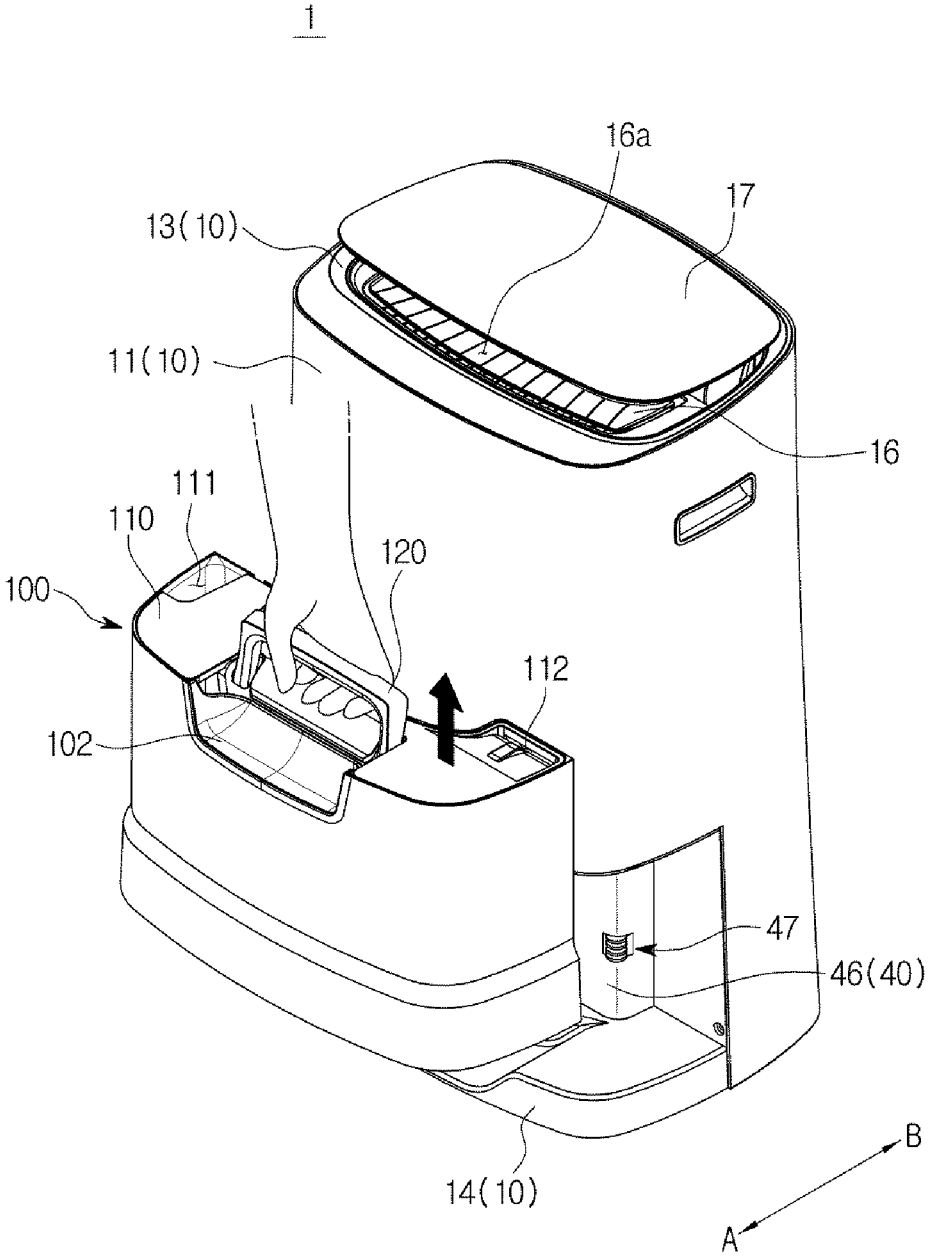

FIGS. 13A to 13C are views illustrating a sequential process in which the water container is sequentially separated from the main body of the dehumidifier according to one embodiment of the present disclosure and transferred.

As illustrated in FIG. 13A, to separate the water container 100 from the main body 10, a user inserts one hand into the recessed member 102 to grip the handle 120, and pulls the water container 100 in the first direction A. At this time, the water container 100 is separated from the main body 10 and moves in the first direction A in a sliding manner. The water container 100 may linearly move while being separated from the main body 10. That is, the water container 100 may be separated from the main body 10 in a sliding manner while maintaining the same posture as when the water container 100 is coupled to the main body 10. The water container 100 may linearly or straightly move while being separated from the main body 10.

As illustrated in FIGS. 13B and 13C, when the water container 100 is completely separated from the main body 10, a user may rotate and grip the handle 120, and lift and move the water container 100.

As described above, by the rotatable handle 120 being applied to the water container 100, a user may sequentially separate the water container 100 from the main body 10 and move the water container 100 separated from the main body 10 as a continuous motion using the handle 120.

The dehumidifier 1 may include a fixed dehumidifier and a movable dehumidifier.

As is apparent from the above description, since the water container is separated from the main body in a sliding manner by the handle, a user can separate the water container from the main body using one hand, and the water container can be prevented from overflowing with condensate to the outside while the water container is separated from the main body.

Since the water container can be separated from the main body and the water container separated from the main body can be moved using one handle, a user convenience of the water container, eventually a user convenience of the dehumidifier can be improved.

As the cover including the drain hole is applied to the water container, condensate stored in the water container can be removed without cumbersomeness such as opening and closing the cover.

As the handle which is normally coupled to the water container and can be separated from the water container only when being leaned a predetermined angle is applied, the handle can be separately coupled to the water container without an additional coupling member.

As the water container is formed of a transparent material, a level of condensate stored in the water container can be checked with the naked eye from the outside.

The handle having an aesthetic quality can be manufactured by a gas ejection method with a transparent material.

As at least a part of the handle which is touched by a user's hand when the user grips the handle is treated into a curved surface, a grip feeling of the handle can be improved.

While the present disclosure has been described above with reference to the specific embodiments, it may not be limited thereto, and it may be understood by those skilled in the art that various modifications may be made without departing from the technical spirit and scope of the present disclosure described in the appended claims.

What is claimed is:

1. A dehumidifier comprising:

a main body including an inlet port and an outlet port;

a heat exchanger configured to exchange heat with air introduced through the inlet port; and a water container configured to accommodate condensate and separately coupled to the main body in a sliding manner, wherein the water container includes:

a handle rotatably coupled to the water container; and a recessed member recessively formed inward from an exterior of the water container below the handle to enable the handle to be gripped through the recessed member when the water container is coupled to the main body, and wherein the handle is coupled to an inner side of a rear surface of the water container and disposed within the recessed member such that the handle is disposed beneath a top surface of the water container when in an ungripped position.

2. The dehumidifier of claim 1, wherein the outlet port is provided at the main body to be opened and closed at a front of the main body, and wherein the water container is separated from the main body forward of the main body in a sliding manner.

3. The dehumidifier of claim 1, wherein a water container seating portion recessively formed for the water container to be seated is provided on one surface of the main body, and wherein a coupling portion separately coupled to a protrusion rib formed on one surface of the water container by elastic deformation is provided on the water container seating portion.

4. The dehumidifier of claim 1, wherein a water container seating portion recessively formed for the water container to be seated is provided on one surface of the main body, and wherein the water container is separately coupled to the water container seating portion to form an exterior of at least one of a front surface and side surfaces of the dehumidifier together with the main body.

5. The dehumidifier of claim 1, wherein the recessed member is recessively formed at a front surface of the water container to be adjacent to the handle.

6. The dehumidifier of claim 5, wherein the recessed member is welded to the front surface of the water container.

7. The dehumidifier of claim 1, wherein the handle is separately coupled to the water container.

8. The dehumidifier of claim 1, wherein the handle includes:

a support portion separately coupled to the water container; and a grip portion connected to the support portion to be gripped.

9. The dehumidifier of claim 8, wherein the support portion and the grip portion are integrally formed with each other.

10. The dehumidifier of claim 8, wherein the grip portion includes a first surface facing an inner side of the water container, and wherein the first surface includes a curved surface which is convex toward the inner side of the water container.

11. The dehumidifier of claim 10, wherein the grip portion further includes a second surface facing an outside of the water container, and wherein the second surface forms a part of an exterior of the dehumidifier when the water container is coupled to the main body.

12. The dehumidifier of claim 11, wherein the grip portion further includes a third surface which connects the first surface to the second surface, and wherein at least one of a connection portion between the first surface and the third surface and a connection portion between the second surface and the third surface includes a curved surface.

13. The dehumidifier of claim 8, wherein a plurality of handle installation portions each of which includes a coupling hole and protrudes toward an inner side of the water container are provided at an inner wall of the water container, and wherein a coupling protrusion which protrudes toward an outside of the handle and is separately coupled to the coupling hole is provided at the support portion.

14. The dehumidifier of claim 13, wherein the coupling protrusion is separable from the coupling hole when the handle is leaned toward a rear of the water container.

15. The dehumidifier of claim 1, wherein at least one of the water container and the handle is formed of a transparent material.

16. A dehumidifier comprising:

a main body including an inlet port and an outlet port;

a heat exchanger configured to exchange heat with air introduced through the inlet port; and a water container slidably coupled to the main body, the water container configured to linearly move from an inserted position in which the water container is inserted into the main body to a decoupled position in which the water container is separated from the main body, wherein the water container includes:

a handle separately coupled to the water container; and a recessed member recessively formed inward from an exterior of the water container below the handle to enable the handle to be gripped through the recessed member when the water container is coupled to the main body, wherein the handle further is configured to be gripped when the water container is separated from the main body and when the water container separated from the marry body is lifted and transferred, and wherein the handle is coupled to an inner side of a rear surface of the water container and disposed within the recessed member such that the handle is disposed beneath a top surface of the water container when in an ungripped position.

17. The dehumidifier of claim 16, wherein the outlet port is provided at the main body to be opened and closed at a front of the main body; and wherein the water container is separated from the main body in a sliding manner forward of the main body.

18. The dehumidifier of claim 16, wherein a water container seating portion recessively formed for the water container to be seated is provided on a front surface of the main body, and wherein the water container is separately coupled to the water container seating portion such that a front surface of the water container is configured to form an exterior of a front surface of the dehumidifier together with the main body.

19. The dehumidifier of claim 16, wherein the handle is leaned toward a front of the dehumidifier when the water container is coupled to the main body, and one surface of the handle leaned toward the front of the dehumidifier forms an exterior of a front surface of the dehumidifier together with the water container and the main body.

20. The dehumidifier of claim 16, wherein the handle is disposed such that a surface of the handle is substantially flush with a surface of the water container, and wherein the surface of the handle is substantially flush with a surface of the main body when the water container is inserted in the main body.

* * * * *